US006978580B1

(12) United States Patent
Clark et al.

(10) Patent No.: US 6,978,580 B1
(45) Date of Patent: Dec. 27, 2005

(54) SOLID CORE CONCRETE BLOCK AND METHOD OF MAKING A CONCRETE BLOCK RETAINING WALL

(76) Inventors: Ryan Clark, 10443 Brookhollow Cir., Highlands Ranch, CO (US) 80126; Lawrence J. Hug, 11304 Canary La., Parker, CO (US) 80138; Michael J. Martinez, 2587 S. Vrain Ct., Denver, CO (US) 80219

( * ) Notice: Subject to any disclaimer, the term of this patent is extended or adjusted under 35 U.S.C. 154(b) by 362 days.

(21) Appl. No.: 10/290,873

(22) Filed: Nov. 8, 2002

(51) Int. Cl.[7] ..... E02D 29/02; E04B 2/00; E04C 2/04

(52) U.S. Cl. ..... 52/311.1; 52/378; 52/603; 52/604; 52/611; 405/284; 405/286; D25/113

(58) Field of Search ..... 52/603, 604, 605, 52/608, 611, 378, 311.1, 513, 609; 405/284, 405/286; D25/113

(56) References Cited

U.S. PATENT DOCUMENTS

| | | | | | |
|---|---|---|---|---|---|
| 457,982 | A | * | 8/1891 | Bohme | 52/574 |
| 776,441 | A | * | 11/1904 | Veyon | 52/307 |
| 802,903 | A | * | 10/1905 | Anderson | 52/279 |
| 884,498 | A | * | 4/1908 | King | 52/89 |
| 915,608 | A | * | 3/1909 | Kaye | 52/599 |
| 1,593,297 | A | * | 7/1926 | Gilmer | 52/386 |
| 1,594,387 | A | * | 8/1926 | Stubbs | 52/606 |
| 1,739,108 | A | * | 12/1929 | Weber | 405/262 |
| 2,320,480 | A | * | 6/1943 | Stagg | 52/302.6 |
| 2,963,828 | A | * | 12/1960 | Belliveau | 52/564 |
| 3,121,525 | A | * | 2/1964 | Hayes | 206/523 |
| D203,590 | S | * | 2/1966 | Davis | D25/113 |
| 4,920,712 | A | * | 5/1990 | Dean, Jr. | 405/286 |
| 4,957,395 | A | * | 9/1990 | Nelson | 405/287 |
| 5,031,376 | A | * | 7/1991 | Bender et al. | 52/609 |
| D343,461 | S | * | 1/1994 | Powell | D25/114 |
| D346,667 | S | * | 5/1994 | Blomquist | D25/113 |
| 5,337,527 | A | * | 8/1994 | Wagenaar | 52/169.2 |
| D362,511 | S | * | 9/1995 | Anderson et al. | D25/113 |
| 5,465,544 | A | * | 11/1995 | Ghahary | 52/311.1 |

(Continued)

FOREIGN PATENT DOCUMENTS

FR 2651258 A1 * 3/1991 ..... E02D 17/18

*Primary Examiner*—Robert Canfield
(74) *Attorney, Agent, or Firm*—Edwin H. Crabtree; Ramon L. Pizarro; Donald W. Margolis

(57) ABSTRACT

A plurality of solid core concrete blocks used in forming a retaining wall. The retaining wall can be used in building construction, road construction, landscaping, hillside erosion control, gardens, and like applications. Also, the retaining wall can be a straight wall, an angled wall or a curved wall depending on the application. Each of the blocks includes a vertical front face and rear face, a horizontal top and bottom and a vertical first side and second side. The first side includes a first ear and two sides of an angular first notch next to the first ear. One side of the first notch is parallel to a length of the front and rear faces and forms a side of the first ear. A second side of the first notch is disposed inwardly into the block and at an angle of 10 to 45 degrees from a horizontal line perpendicular to a length of the front and rear faces. When the first ear is broken off, a length of the second side of the first notch is extended for engaging a side of another block having a second ear broken off. In this manner, the retaining wall can be angled or curved during the wall construction.

9 Claims, 3 Drawing Sheets

U.S. PATENT DOCUMENTS 5,490,363 A * 2/1996 Woolford ..... 52/604
5,588,786 A * 12/1996 House et al. ..... 405/285
5,941,042 A * 8/1999 Dueck ..... 52/604
6,000,183 A * 12/1999 Newman ..... 52/311.1
D422,092 S * 3/2000 Perkins ..... D25/113
D479,342 S * 9/2003 Dawson ..... D25/113
2002/0083657 A1 * 7/2002 Mattox et al. ..... 52/125.2
2003/0070385 A1 * 4/2003 Bott ..... 52/606
2003/0213203 A1 * 11/2003 Bott et al. ..... 52/603
2004/0028484 A1 * 2/2004 Woolford ..... 405/286

* cited by examiner

SOLID CORE CONCRETE BLOCK AND METHOD OF MAKING A CONCRETE BLOCK RETAINING WALL

BACKGROUND OF THE INVENTION (a) Field of the Invention

This invention relates to a concrete block retaining wall and more particularly, but not by way of limitation, to a unique solid core concrete block and a plurality of the concrete blocks used in building a concrete block retaining wall. The retaining wall can be used in building construction, road construction, landscaping, hillside erosion control, gardens, and like applications (b) Discussion of Prior Art Heretofore, there have been a variety of different types of concrete blocks, bricks, railroad ties and other types of materials used in retaining wall construction. In U.S. Pat. No. 5,788,423 to Perkins, U.S. Pat. No. 6,000,183 to Newman and U.S. Pat. No. 5,465,544 to Ghahary different types of decorative face plates or facing panels are illustrated for attaching to the front of concrete blocks used in retaining walls. In U.S. Pat. No. 5,568,999 to Egan et al. and U.S. Pat. No. 5,992,102 to Ozawa, two different types retaining wall block systems are disclosed using plastic wall blocks and cellular resin blocks.

None of the above mentioned prior art patents specifically disclose the unique features, structure and function of the subject solid core concrete block and method of making a concrete block retaining wall as described herein.

SUMMARY OF THE INVENTION

In view of the foregoing, it is a primary objective of the subject invention to provide a plurality of solid core concrete blocks that can be easily stacked one on top of the other for forming different designs, sizes and shapes of retaining walls.

Another object of the invention is each of the solid core concrete blocks includes a pair of ears extending outwardly from opposite sides of the block. The ears can be used for carrying the block to the retaining wall construction site and for placing it in position on the wall. The blocks also include inwardly angular notches next to the ears. When the ears are broken off, the notch sides, which are angled from 10 to 45 degrees, can be used for creating a curved retaining wall.

Still another object of the solid core blocks is the ears on the blocks allow three 8" by 8" by 18" blocks to be made at one time in a standard size 18½" by 26½" concrete mold used in a concrete block machine. While the dimensions of the mold are described above, the mold can be of various dimensions for making different sizes of retaining wall blocks. This feature provides for reduced block cost and increases the efficiency in making the blocks.

Yet another object of the invention is each block can include a pair of parallel bracket grooves in the top of the block. The bracket grooves are used for receiving a pair of brackets used to suspend a decorative facing on a front of the block.

A further object of the invention is the use of a fabric sheet disposed between every layer of the block, every two layers of blocks or as needed. The fabric sheet is received on top of compacted dirt backfill behind the wall. Additional backfill is received on top of the fabric sheet. The fabric sheet is used to hold the wall in place due to the force of the soils on the back side of the retaining wall.

The invention includes a plurality of solid core blocks used in forming a retaining wall. Each of the blocks includes a vertical front face and rear face, a horizontal top and bottom and a vertical first side and second side. The first side includes a first ear and two sides of an angular first notch next to the first ear. One side of the first notch is parallel to a length of the front and rear faces and forms a side of the first ear. A second side of the first notch is disposed inwardly into the block and at an angle of 10 to 45 degrees from a horizontal line perpendicular to a length of the front and rear faces. When the first ear is broken off, a length of the second side of the first notch is extended for engaging a side of another block when turning an angle during the wall construction. The second side of the block includes a second ear and two sides of an angular second notch similar to the first side of the block.

These and other objects of the present invention will become apparent to those familiar with various types of concrete blocks, concrete block machine molds and different methods of making retaining walls when reviewing the following detailed description, showing novel construction, enlarged, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate preferred embodiments of the present invention according to the best modes presently devised for the practical application of the principles thereof, and in which.

DESCRIPTION OF THE PREFERRED EMBODIMENTS

Figure 1:
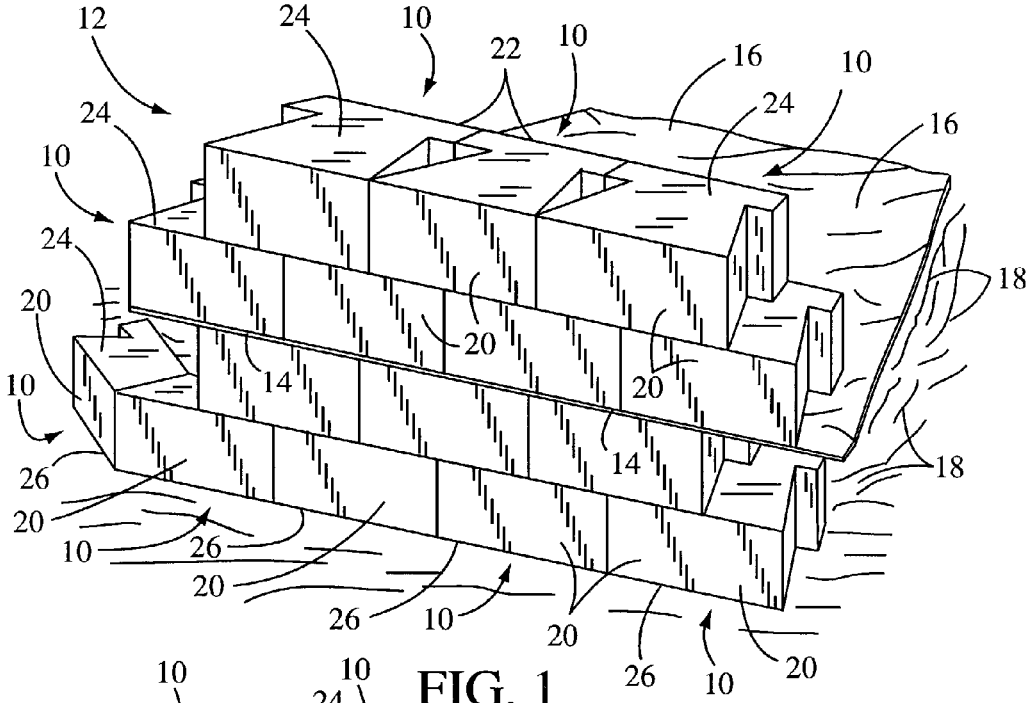
FIG. 1 is a perspective view of a plurality of the subject solid core concrete blocks forming a concrete block retaining wall. This drawing illustrates four rows of blocks with one side of a fabric sheet received between the second and third rows of blocks. The fabric sheet extends from the rear of the wall and is received over dirt backfill.

In FIG. 1, a perspective view of a plurality of the subject solid core concrete blocks are shown and having general reference numeral 10. The blocks 10 are used for forming a concrete block retaining wall. The retaining wall is shown having a general reference numeral 12. The retaining wall can be straight wall, curved wall or angled wall or a combination of both. This drawing illustrates four rows of the blocks 10 with one side 14 of a fabric sheet 16 received between the second and third rows of blocks 10. The fabric sheet 16 extends from the rear of the retaining wall 12 and is received over dirt backfill 18. As the rows of blocks 10 extend upwardly additional fabric sheets 16 can be installed between every row of block or as required with additional compacted dirt backfill 18 placed on top of the sheets. The sheets 16 are used to hold the retaining wall in place due to pressure from the compacted dirt behind the wall. It should be noted that the solid core blocks have sufficient weight and sufficient surface area on the top and bottom of the blocks to hold the fabric sheet in place without pulling loose from between the blocks when the dirt backfill exerts pressure on the back side of the retaining wall.

Figure 1A:
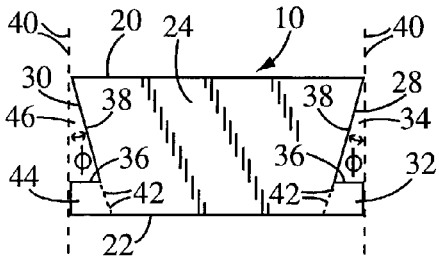
FIG. 1A is a top view of one of the concrete blocks illustrating ears and angular notches in the first and second sides of the block.

In FIG. 1A, a top view of one of the concrete blocks 10 is shown. Referring to both FIG. 1 and FIG. 1A, the concrete block 10 includes a vertical front face 20, a vertical rear face 22, a horizontal top 24, a horizontal bottom 26, a vertical first side 28 and a vertical second side 30.

The first side 28 includes a first ear 32 and two sides of an angular first notch 34 next to the first ear 32. One notch side 36 of the first notch 34 is parallel to a length of the front and rear faces 20 and 22. The notch side 36 is also one side of the first ear 32. Another notch side 38 of the first notch 34 is disposed inwardly into the block and at an angle $\phi$. The angle $\phi$ can be in a range of 10 to 45 degrees from a dashed horizontal line 40. The line 40 is perpendicular to a length of the front and rear faces 20 and 22.

When the first ear 34 is broken off along a dashed line 42, a length of the second notch side 38 of the first notch 34 is extended. The extended notch side 38 is used for engaging a similar second side 30 of another block 10. The feature of removing the first ear 34 of one block and removing a second ear 44 from an adjacent block is used when providing a curve or angle in the retaining wall 12. Note on the left side of the lower row of bricks in FIG. 1, two blocks 10 are shown with ears removed and illustrating the curving or angling of the retaining wall 12. The second side 30 of the block 10 includes the second ear 44 and an angular second notch 46 having a notch side 36 and another notch side 38, similar to the first side 28 of the block 10. The first and second ears 32 and 44 are disposed next to the rear face 22 of the blocks 10.

Figure 2:
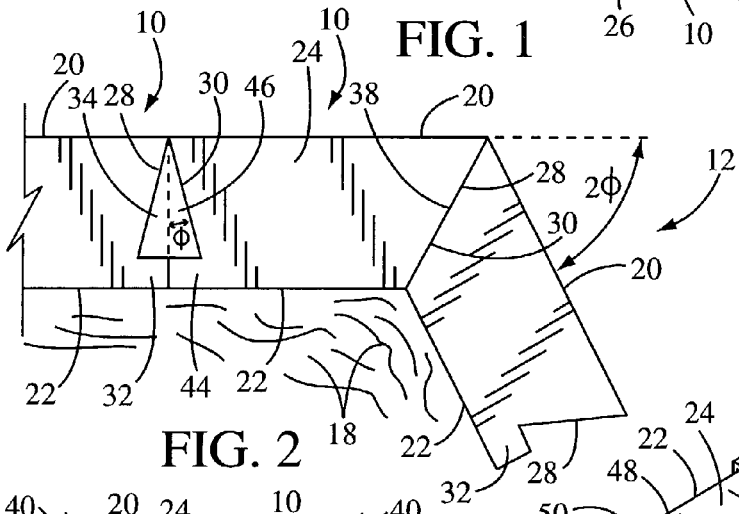
FIG. 2 is a top view of three blocks disposed next to each other and with two of the blocks having their ears removed for forming a curved retaining wall.

In FIG. 2, a top view of three blocks 10 are shown disposed next to each other. The two blocks 10 on the right are shown with a first ear 32 removed from the center block and a second ear 44 removed from the right. The extended notch sides 38 are now placed next to each other for forming a curved or angled retaining wall 12. In this example, if the angle $\phi$ in the first and second notches 34 and 46 is 15 degrees, then the curved retaining 12 is now turned at an angle of $2\phi$ or 30 degrees. Obviously, if the angle $\phi$ was 45 degrees in the side of the block 10, the retaining wall 12 can be turned at a right angle or 90 degrees. Also, if the angle $\phi$ is 10 degrees, the retaining wall 12 is turned 20 degrees. The greater the angle $\phi$, the greater the curve formed when building the wall 12.

Figure 3:
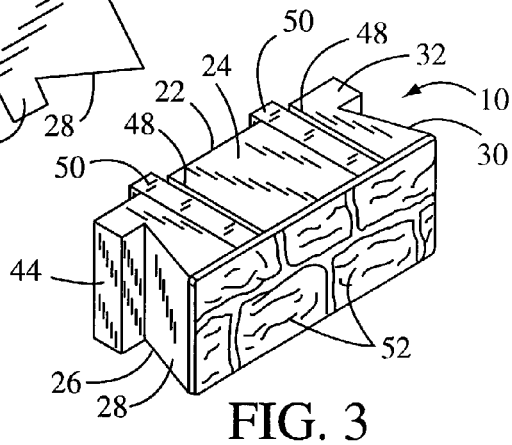
FIG. 3 is a perspective view of one of the concrete blocks with a pair of parallel bracket grooves in the horizontal top of the block for receiving a pair of brackets. The brackets are used to suspend a decorative facing in the front of a front face of the block.

In FIG. 3, a perspective view of one of the concrete blocks 10 is shown with a pair of parallel bracket grooves 48 in the horizontal top 24 of the block for receiving a pair of hanger brackets 50. The hanger brackets 50 are used to suspend a decorative facing 52 in the front of the front face 20 of the block 10. The decorative face 52 can have the appearance of a brick wall, a stone wall or other exterior wall designs.

Figure 4:
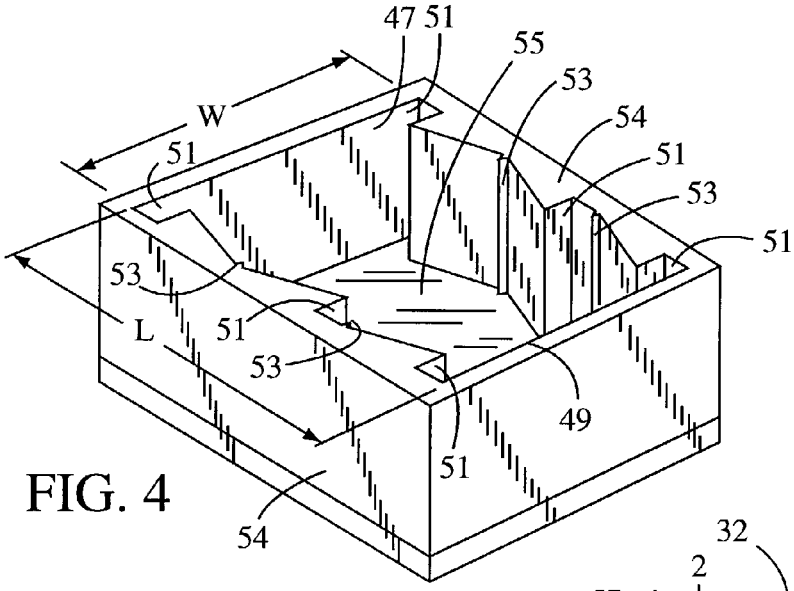
FIG. 4 is a perspective view of a concrete block machine female mold used for forming an enlarged concrete block, which is split into three of the solid core blocks.
Figure 5:
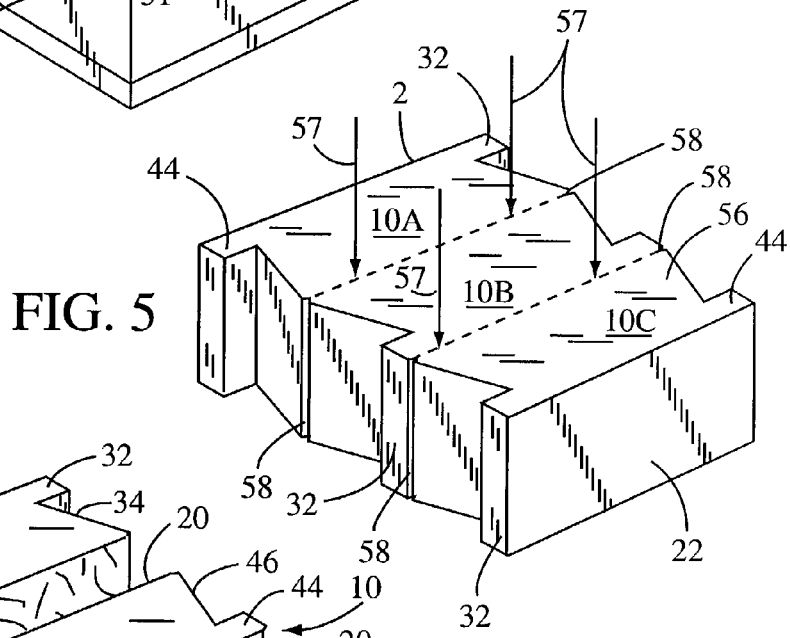
FIG. 5 is a perspective view of the enlarged concrete block removed from the female mold shown in FIG. 4 and prior to splitting the enlarged block into three separate blocks using "V" notches in opposite sides of the enlarged block.

In FIG. 4, a perspective view of a standard concrete block machine female mold 54 is shown having a unique cavity 55 therein and used for forming an enlarged concrete block 56, which is split into three of the solid core blocks 10. The three solid core blocks are shown as blocks 10A, 10B and 10C and illustrated in FIGS. 5 and 6. The cavity 55 has a standard dimension of a width "W" or 18½" and a length "L" or 26½". By the nature of the design of the subject solid core concrete blocks 10, three of the blocks can be formed from the enlarged concrete block 56. The enlarged concrete block is shown in FIG. 5. While the dimension of the cavity 55 are mentioned above, it should be kept in mind the cavity can have different dimensions for making different size blocks used in the retaining wall.

The cavity 55 includes four outwardly extending vertical "V" shaped points 53 for forming vertical "V" notches 58 in the opposite sides of the enlarged concrete block 56. Also, the cavity 55 includes ear spaces 51 in opposite sides of the cavity for forming first and second ears 32 and 44 next to the rear face 22 of the blocks 10A and 10C, shown in FIG. 6. blocks. Further, along the length "L" of the cavity 55 are ear spaces 51 for forming ears 32 and 44 in the block 10B, shown in FIG. 6. The forming of the ears 32 and 44 in the cavity provides for a full-length rear face 22 having a length of 18" and a width of 8". These dimensions of the rear face 22 are identical to the length and width of the front face 20 of the block 10. Still further, the opposite sides of the cavity 55 next to the ear spaces 51 are angled for forming the first and second notches 34 and 46 in the vertical sides 28 and 30 of the blocks 10A, 10B and 10C. A first end 47 of the cavity 55 is used for forming the flat vertical rear face 22 of block 10A. A second end 49 of the cavity is used for forming the flat vertical rear face 22 of block 10C.

In FIG. 5, a perspective view of the enlarged concrete block 56 is shown and removed from the female mold 54. Using a concrete block splitter, shown as arrows 57, and with the aid of the "V" notches 58 formed in the opposite sides of the enlarged block 56, the enlarged block 56 is split into blocks 10A, 10B and 10C.

The two upper arrows 57, representing the splitter, split the vertical front face 20 of block 10A away from the vertical front face 20 of block 10B. The two lower arrows 57, representing the splitter, split the vertical rear face 22 of block 10B away from the vertical front face of block 10C. In this manner and using the design of the female mold 54 with cavity 55, three identical blocks are formed and shown as blocks 10A, 10B and 10C.

Figure 6:
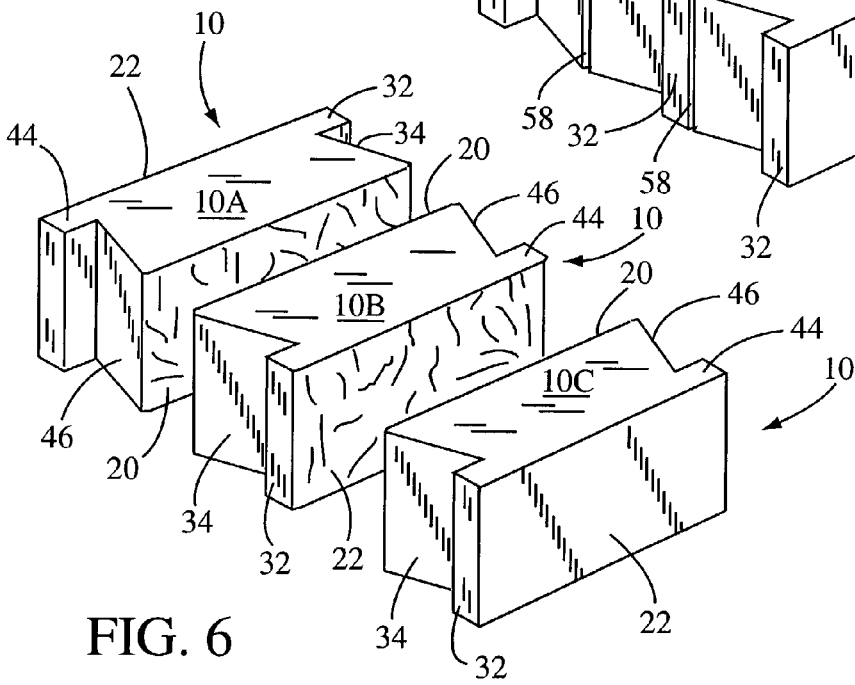
FIG. 6 is a perspective view of the three individual blocks split apart.

In FIG. 6, a perspective view of the three individual blocks 10 are illustrated and split apart. As mentioned above, forming the enlarged block 56 and splitting it into three identical blocks 10A, 10B and 10C with improved efficiency of ⅓ during the production of each cycle in the concrete block machine. Also, the cost per block is greatly reduced.

Figure 7:
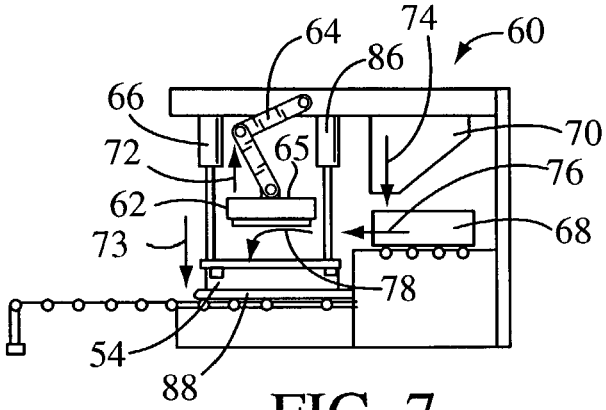
FIG. 7 is a side view of a standard concrete block machine with a moveable head in a raised position, a pair of moveable cylinders for lowering and raising the female mold and a feed drawer disposed under a concrete hopper.

In FIG. 7, a side view of a standard concrete block machine is shown having a general reference numeral 60. The concrete block machine 60 includes a moveable head 62 with linkage 64 for raising and lowering the head 62. Also, the bottom of the head includes a male mold 65 attached thereto for inserting into the top of the female mold 54. The female mold 54 is attached to a pair of moveable cylinders 66 used for raising and lowering the mold 54. Also, the block machine 60 includes a feed drawer 68 disposed under a concrete hopper 70 for receiving the zero slump concrete and feeding it into the top of the female mold 54.

In this drawing, the linkage has moved the head 62 in a raised position, as indicated by arrow 72 and the female mold 54 is in a lower position, as indicated by arrow 73. The hopper 70 is shown feeding the concrete into the feed drawer 68, as indicated by arrow 74. When the feed drawer 68 has been filled, it is moved above the female mold 54, as indicated by arrow 76. At this time, the concrete drops into and fills the mold cavity 55 of the mold 54, as indicated by arrow 78.

Figure 8:
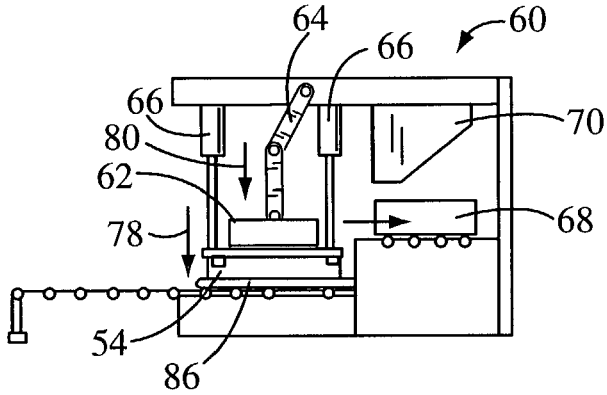
FIG. 8 is another side view of the concrete block machine with the moveable head in a lowered position on top of the female mold for compacting and vibrating the concrete in the female mold.

In FIG. 8, another side view of the concrete block machine 60 is shown with the moveable head 62 in a lowered position, as indicated by arrow 80. The male mold 65 is inserted into an upper portion of the cavities 56 of the female mold 54. The head 62 now compresses and vibrates the concrete in the female mold. The feed drawer 68 is shown moved back and positioned under the concrete hopper 70, as indicated by arrow 82.

Figure 9:
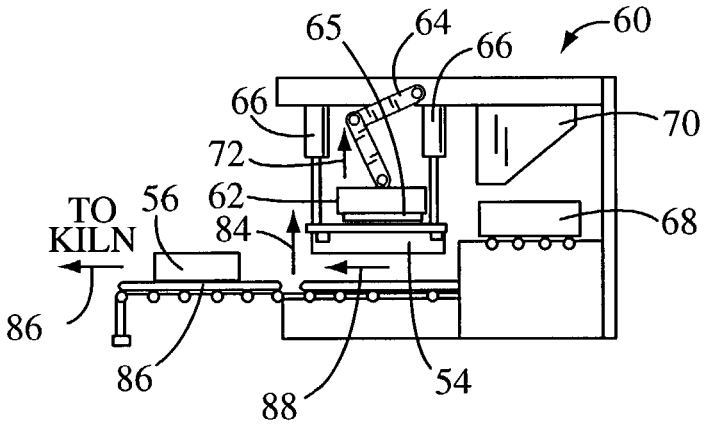
FIG. 9 is still another side view of the block machine with moveable head in a raised position and the female mold in a raised position. The completed enlarged concrete block is shown on a conveyor pallet moved to the left and having exited from the concrete block machine.

In FIG. 9, still another side view of the block machine 60 is shown. In this drawing, the making of the enlarged block 56 is completed and the moveable head 62 is shown in a raised position, as indicated by arrow 72. Also, the female mold 54 is shown in a raised position, as indicated by arrow 84. The completed enlarged block 56 is shown on a conveyor pallet 86 moved to the left, as indicated by arrow 88, and away from the concrete block machine 60. The enlarged block is now ready to be sent to a kiln for heating and curing of the concrete before being split into individual solid core concrete blocks 10, as shown in FIG. 5.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A plurality of solid core concrete blocks used in forming a straight, a curved or an angled retaining wall and for holding dirt backfill behind the wall, each of the concrete blocks comprising:

a vertical front face and a vertical rear face;

a horizontal top and a horizontal bottom, said horizontal top having a pair of parallel bracket grooves therein, said bracket grooves for receiving a pair of hanger brackets, said hanger brackets suspending a decorative facing in front of said vertical front face;

a vertical first side, said first side including a first ear and two notch sides of an angular first notch next to said first ear; and a vertical second side, said second side including a second ear and two notch sides of an angular second notch next to said second ear;

whereby said first ear and said second ear can be used for lifting and carrying the blocks, whereby when said first ear and second ear are broken, the blocks can be used for curving, angling or making corners in the retaining wall.

2. The concrete blocks as described in claim 1 wherein one notch side of said first notch in said first side is parallel to a length of said front and rear faces and forms a side of said first ear, a second notch side of said first notch is disposed inwardly at an angle from a horizontal line perpendicular to a length of said front and rear faces.

3. The concrete blocks as described in claim 2 wherein the second notch side of said first notch in said first side is disposed at an angle in a range of 10 to 45 degrees from the horizontal line perpendicular to the length of said front and rear faces.

4. The concrete blocks as described in claim 1 wherein one notch side of said second notch in said second side is parallel to a length of said front and rear faces and forms a side of said second ear, a second notch side of said second notch is disposed inwardly at an angle from a horizontal line perpendicular to a length of said front and rear faces.

5. The concrete blocks as described in claim 4 wherein the second notch side of the second side is disposed at an angle in a range of 10 to 45 degrees from the horizontal line perpendicular to the length of said front and rear faces.

6. A plurality of solid core concrete blocks used in forming a straight, a curved or an angled retaining wall and for holding dirt backfill behind the wall, each of the concrete blocks comprising:

a vertical front face and a vertical rear face;

a horizontal top and a horizontal bottom, said horizontal top having a pair of parallel bracket grooves therein, said bracket grooves for receiving a pair of hanger brackets, said hanger brackets suspending a decorative facing in front of said vertical front face;

a vertical first side, said first side including a first ear and two notch sides of an angular first notch next to said first ear, one notch side of said first notch in said first side is parallel to a length of said front and rear faces and forms a side of said first ear, a second notch side of said first notch is disposed inwardly at an angle from a horizontal line perpendicular to a length of said front and rear faces; and a vertical second side, said second side including a second ear and two notch sides of an angular second notch next to said second ear; one notch side of said second notch in said second side is parallel to a length of said front and rear faces and forms a side of said second ear, a second notch side of said second notch is disposed inwardly at an angle from a horizontal line perpendicular to a length of said front and rear faces;

whereby said first ear and said second ear can be used for lifting and carrying the blocks, whereby when said first ear and second ear are broken, the blocks can be used for curving, angling or making corners in the retaining wall.

7. The concrete blocks as described in claim 6 wherein the second notch side of said first notch in said first side is disposed at an angle in a range of 10 to 45 degrees from the horizontal line perpendicular to the length of said front and rear faces.

8. The concrete blocks as described in claim 6 wherein the second notch side of the second side is disposed at an angle in a range of 10 to 45 degrees from the horizontal line perpendicular to the length of said front and rear faces.

9. A plurality of solid core concrete blocks used in forming a straight, a curved or an angled retaining wall and for holding dirt backfill behind the wall, each of the concrete blocks comprising:

a vertical front face and a vertical rear face;

a horizontal top and a horizontal bottom, said horizontal top having a pair of parallel bracket grooves therein, said bracket grooves for receiving a pair of hanger brackets, said hanger brackets suspending a decorative facing in front of said vertical front face;

a vertical first side, said first side including a first ear and two notch sides of an angular first notch next to said first ear, one notch side of said first notch in said first side is parallel to a length of said front and rear faces and forms a side of said first ear, a second notch side of said first notch in said first side is disposed at an angle in a range of 10 to 45 degrees from the horizontal line perpendicular to the length of said front and rear faces; and a vertical second side, said second side including a second ear and two notch sides of an angular second notch next to said second ear; one notch side of said second notch in said second side is parallel to a length of said front and rear faces and forms a side of said second ear, a second notch side of said second side is disposed at an angle in a range of 10 to 45 degrees from the horizontal line perpendicular to the length of said front and rear faces;

whereby said first ear and said second ear can be used for lifting and carrying the blocks, whereby when said first ear and second ear are broken, the blocks can be used for curving, angling or making corners in the retaining wall.

* * * * *